US006994604B1

(12) United States Patent
Wynveen et al.

(10) Patent No.: US 6,994,604 B1
(45) Date of Patent: Feb. 7, 2006

(54) METHOD FOR INHIBITING WATER INGESTION IN A FOUR CYCLE MARINE ENGINE

(75) Inventors: Steve Wynveen, Germantown, WI (US); Kenneth G. Lemberger, Oshkosh, WI (US); Stuart M. Halley, Brownsville, WI (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 10/872,341

(22) Filed: Jun. 18, 2004

(51) Int. Cl.
*B63H 21/38* (2006.01)

(52) U.S. Cl. ..... 440/88 A; 440/89 R

(58) Field of Classification Search ..... 440/1, 440/89 R, 88 L, 88 A; 60/310, 324; 123/198 R, 123/339.19, 339.23, 399, 400, 585, 587
See application file for complete search history.

(56) References Cited

U.S. PATENT DOCUMENTS

| | | | | |
|---|---|---|---|---|
| 3,552,121 A | | 1/1971 | Kitagawa et al. | 60/30 |
| 4,350,010 A | | 9/1982 | Yukishima | 60/310 |
| 4,434,778 A | * | 3/1984 | Morita et al. | 123/587 |
| 5,324,217 A | | 6/1994 | Mineo | 440/89 |
| 5,408,969 A | * | 4/1995 | Obaraki et al. | 123/336 |
| 5,528,930 A | * | 6/1996 | Park | 73/117.3 |
| 5,554,057 A | * | 9/1996 | Abe et al. | 440/89 R |
| 5,558,549 A | | 9/1996 | Nakase et al. | 440/88 |
| 5,730,108 A | * | 3/1998 | Hill | 123/531 |
| 6,077,137 A | | 6/2000 | Hahn | 440/89 |
| 6,499,455 B1 | * | 12/2002 | Page et al. | 123/198 R |
| 6,520,147 B1 | * | 2/2003 | Kanno | 123/339.23 |

* cited by examiner

*Primary Examiner*—Lars A. Olson
(74) *Attorney, Agent, or Firm*—William D. Lanyi

(57) ABSTRACT

A method is provided for avoiding water ingestion through an exhaust system into the cylinders of an engine during an engine shutdown procedure. Air is allowed to flow into the air intake conduit, either through an opened throttle plate or through an opened idle air control valve to raise the pressure within the intake conduit toward equalization with atmospheric pressure. This reduces the negative pressure of the intake conduit relative to the exhaust conduit and inhibits ingestion of water upwardly from a body of water through the exhaust conduit into the cylinder.

17 Claims, 4 Drawing Sheets

METHOD FOR INHIBITING WATER INGESTION IN A FOUR CYCLE MARINE ENGINE

BACKGROUND OF THE INVENTION

1. Field of the Invention

The present invention is generally related to a control system for a marine engine and, more particularly, to a control system which takes specific actions during an engine shutdown procedure to avoid water inversion through the exhaust system and into the engine cylinders.

2. Description of the Prior Art

Certain known types of gasoline engines are designed in such a way that both the intake and exhaust valves can simultaneously be opened because of an intentional overlap in their respective opening and closing sequences. The purpose of the overlap is to permit more efficient evacuation of exhaust gases from the engine's cylinders. However, this technique can result in a negative pressure within the intake system, between the throttle and the cylinders, when the engine is operating at idle speed. This negative pressure, during an engine shutdown procedure, can be connected in fluid communication with the exhaust system if the intake and exhaust valves are simultaneously open and, as a result, can draw water in a reverse direction through the engine's exhaust conduits from a body of water in which the marine vessel is operating and cause that water to flow into the engine's cylinders. This situation represents one mechanism by which water can be drawn into the power cylinder and is known to those skilled in the art as "water reversion" or "water ingestion". This ingestion of water into the cylinders can be significantly deleterious to the operation of the engine and, if it results in water lock within the cylinders, can result in a potentially catastrophic failure.

If an engine stops operating with its intake and exhaust valves opened simultaneously in any cylinder, the negative pressure that exists between the throttle plate of the intake manifold and the intake valve can be connected directly through the combustion chamber to the exhaust manifold. This connection of a reduced pressure, which is less than atmospheric pressure, to the exhaust manifold can cause water to be drawn in a reverse direction through the exhaust system and into the cylinder. The magnitude of the negative pressure (i.e. less than atmospheric pressure) and the volume of air at that negative pressure between the throttle plate and the intake valve combine to determine the degree with which water is drawn in a reverse direction through the exhaust system. If the volume between the throttle plate and the intake valves is significant, and the negative pressure is sufficient, enough water can be drawn upwardly through the exhaust system to cause some of that water to flow in a reverse direction through the exhaust valve and into the power cylinder. Those skilled in the art of marine propulsion systems are familiar with this concept. Many different techniques have been used in an attempt to inhibit water reversion or water ingestion and lessen its potential deleterious effects.

U.S. Pat. No. 6,077,137, which issued to Hahn on Jun. 20, 2000, describes an anti-ingestion device for use with an engine, preferably a marine engine. The device comprises an exhaust manifold or riser system for exhausting engine gases, wherein the exhaust manifold has a first end and a second end, and the first end is connected to a cylinder head. There is a one-way pressure relief valve having a first end and a second end, wherein the first end is coupled to the exhaust manifold and the second end is exposed to atmospheric pressure.

U.S. Pat. No. 5,558,549, which issued to Nakase et al. on Sep. 24, 1996, describes a four cycle engine for a watercraft. Induction and exhaust systems are provided for the engine which includes position responsive valves that close when the watercraft is inverted to preclude from entering the combustion chamber through either the intake or the exhaust system.

U.S. Pat. No. 5,324,217, which issued to Mineo on Jun. 28, 1994, describes an exhaust system for a small watercraft which includes a water trap device for precluding water from entering the engine through the exhaust system if the watercraft becomes inverted, from entering.

U.S. Pat. No. 4,350,010, which issued to Yukishima on Sep. 21, 1982, describes an exhaust system for an outboard engine which has a casing, an internal combustion engine and a water cooling circuit and an exhaust pipe. The exhaust pipe discharges exhaust gases into an expansion chamber and gases from the expansion chamber are discharged into the body of water in which the vessel propelled by the engine floats. The exhaust pipe projects into the expansion chamber and has pores near its outlet end. Coolant water is discharged into the expansion chamber and mixes with the exhaust gases. Gas flow through the pores discourages reverse flow of water droplets through the exhaust pipe to the engine cylinders.

U.S. Pat. No. 3,552,121, which issued to Kitagawa et al. on Jan. 5, 1971, describes a means for preventing reverse water flow through an exhaust pipe of a rotary piston type marine engine. A reverse water flow arrester for a Wankel type rotary piston engine having an exhaust pipe with one end connected with an exhaust working chamber of the engine and the other end inserted into water for discharging exhaust gas thereinto, said arrester comprising a vacuum valve for relieving negative pressure created during engine start within the engine exhaust working chamber in order to prevent the water taken into the engine due to negative pressure and means for interconnecting the vacuum valve with engine starting means to open the valve during engine start.

The patents described above are hereby expressly incorporated by reference in the description of the present invention.

SUMMARY OF THE INVENTION

A method for operating a marine engine, in accordance with a preferred embodiment of the present invention, comprises the steps of detecting an imminent cessation of operation of an engine and then increasing the pressure within the intake conduit of the engine relative to the pressure within the exhaust conduit of the engine upon detection of the imminent cessation of operation of an engine.

The detecting step can comprise the steps of determining an operating speed of the engine and determining that the operating speed is less than a preselected threshold magnitude. In one preferred embodiment, the detecting step can further comprise the step of determining that the operating speed is both decreasing and less than a preselected threshold magnitude. Alternatively, an engine shutdown signal, received from an operator of a marine vessel, can be received by an engine control unit as a signal of the imminent cessation of operation of the engine.

In order to increase the relative pressure of the intake conduit of the engine, in relation to the pressure within the exhaust conduit of the engine, the method of the present invention can cause an air intake throttle plate to move to an increasingly opened position. Alternatively, this pressure increasing step can comprise the step of causing an idle air control (IAC) valve, or another throttle air bypass valve, to move to an increasingly opened position. In a preferred embodiment of the present invention, the engine is a four cycle engine and the pressure increasing step comprises the step of causing the pressure within the intake conduit to become closer in magnitude to the ambient pressure upstream of a throttle plate of the engine.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
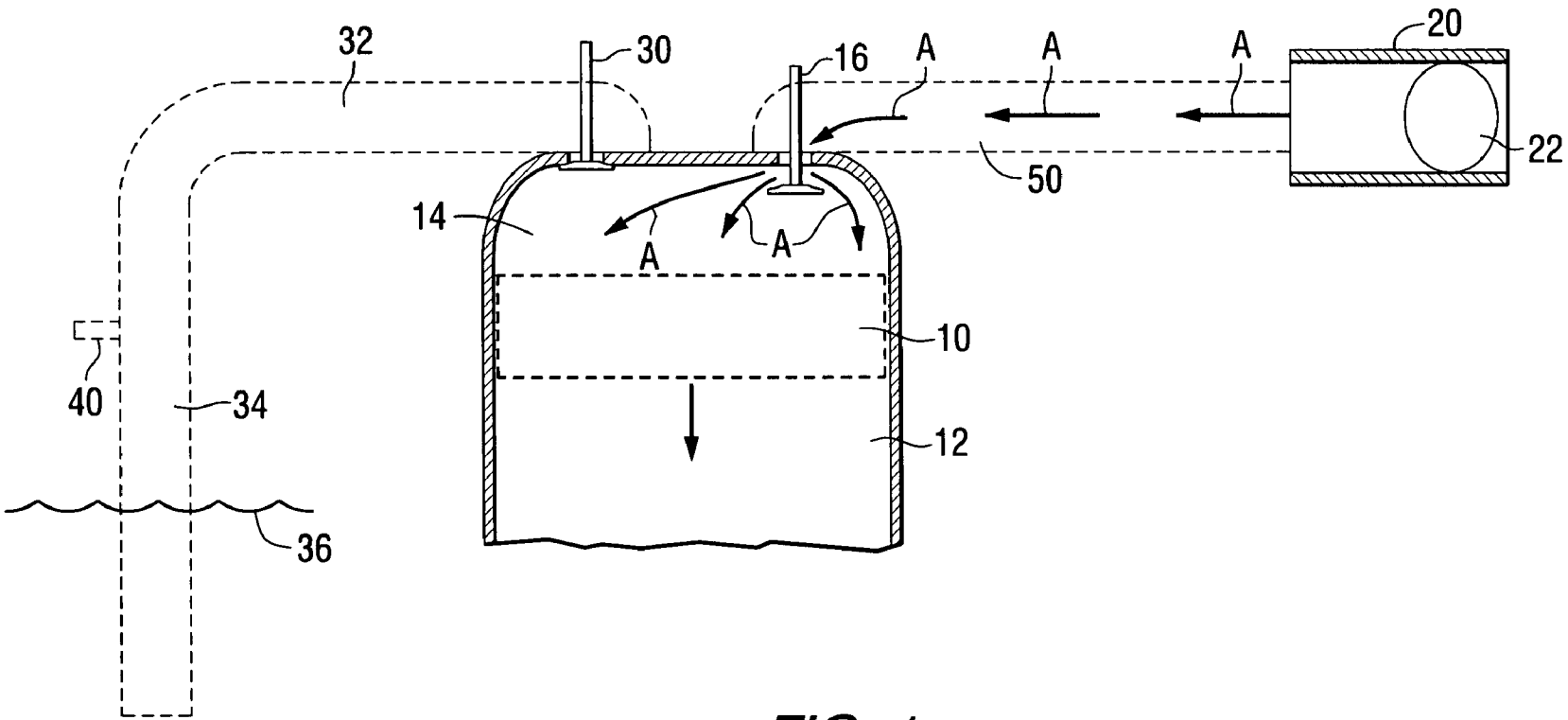
FIG. 1 is a simplified schematic representation showing a normal intake stroke of a four cycle engine.

Throughout the description of the preferred embodiment of the present invention, like components will be identified by like reference numerals.

In order to understand the method of the present invention, it is helpful to understand the normal way that a four cycle engine operates. FIG. 1 shows an intake stroke of a piston 10; represented by dashed lines, which moves reciprocally within a cylinder 12. As the piston 10 moves toward the crankshaft, the pressure within the combustion chamber 14 is decreased and, with an intake valve 16 moved to an open position, air is drawn into the combustion chamber 14, as represented by arrows A. This air first flows through a throttle body mechanism 20 in which a throttle plate 22 is in a generally open position. If, the exhaust valve 30 is in a closed position, as shown in FIG. 1, during the intake stroke, the exhaust conduit 32 is not connected in fluid communication with the combustion chamber 14. For purposes of reference, a downwardly extending leg 34 of the exhaust conduit 32 is illustrated with a lower end disposed below the surface level 36 of the surface of a body of water in which the marine engine is operated. Also for purposes of reference, an idle exhaust relief conduit 40 is illustrated and shown connected in fluid communication with the downward leg 34 of the exhaust conduit 32. Those skilled in the art of marine engines are familiar with the nature and purpose of the idle exhaust relief conduit 40.

Figure 2:
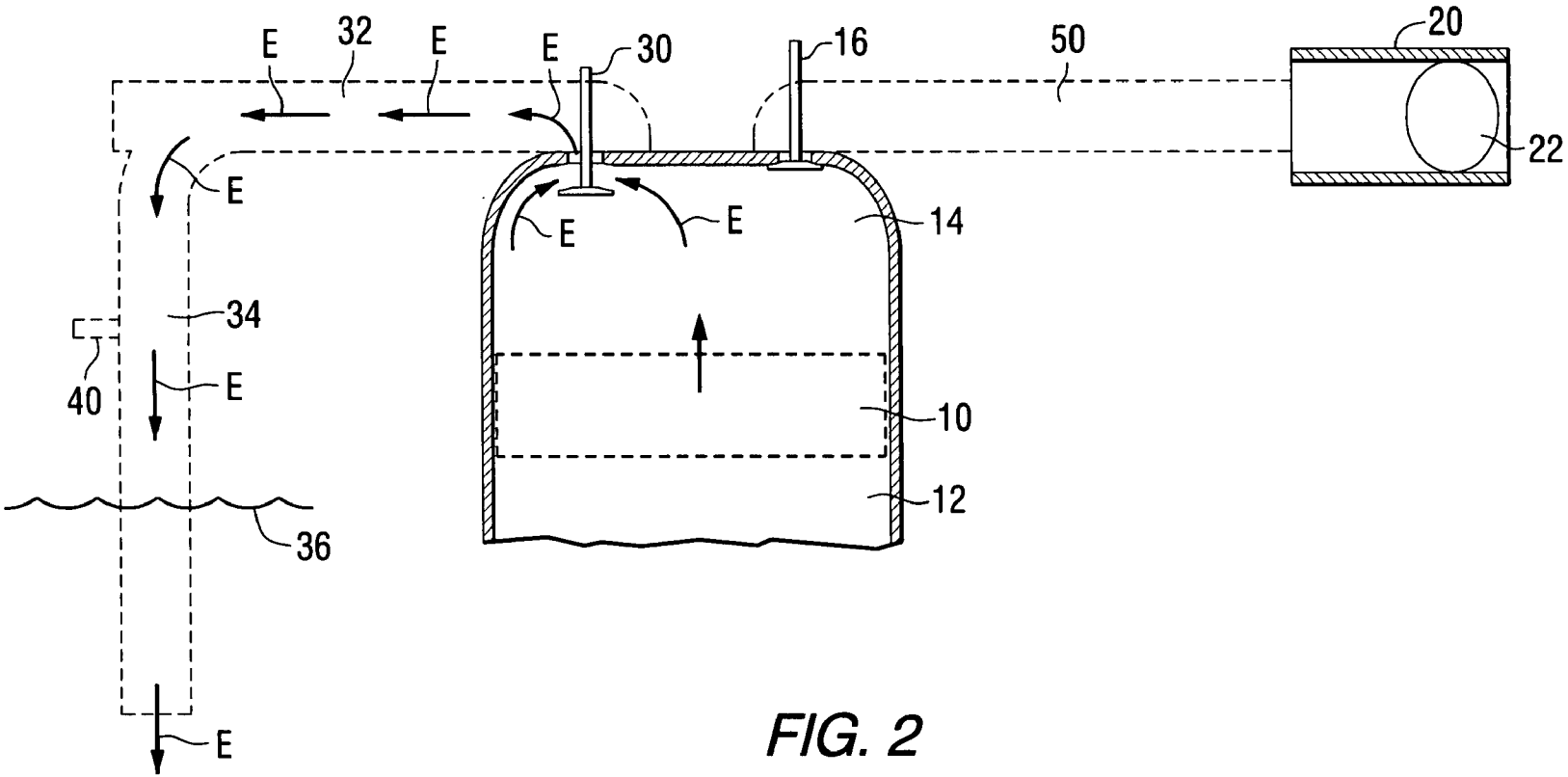
FIG. 2 is a simplified schematic representation showing a normal exhaust stroke of a four cycle engine.

FIG. 2 is a simplified schematic representation of the system described above in conjunction with FIG. 1, but shown during a portion of the sequence when the piston 10 is moving up, away from the crankshaft, and increasing the pressure within the combustion chamber 14. With the exhaust valve 30 in an open position and the intake valve 16 in a closed position, exhaust gases are caused to flow away from the combustion chamber 14 and into the exhaust conduit 32. This results in the flow of exhaust gases, as represented by arrows E, through the exhaust conduit 32, downwardly through the extension 34 of the exhaust conduit 32, and out of the exhaust system beneath the surface 36 of the body of water. The idle exhaust relief conduit 40 can possibly allow some of the exhaust to exit through it under most, if not all, operating conditions.

Figure 3:
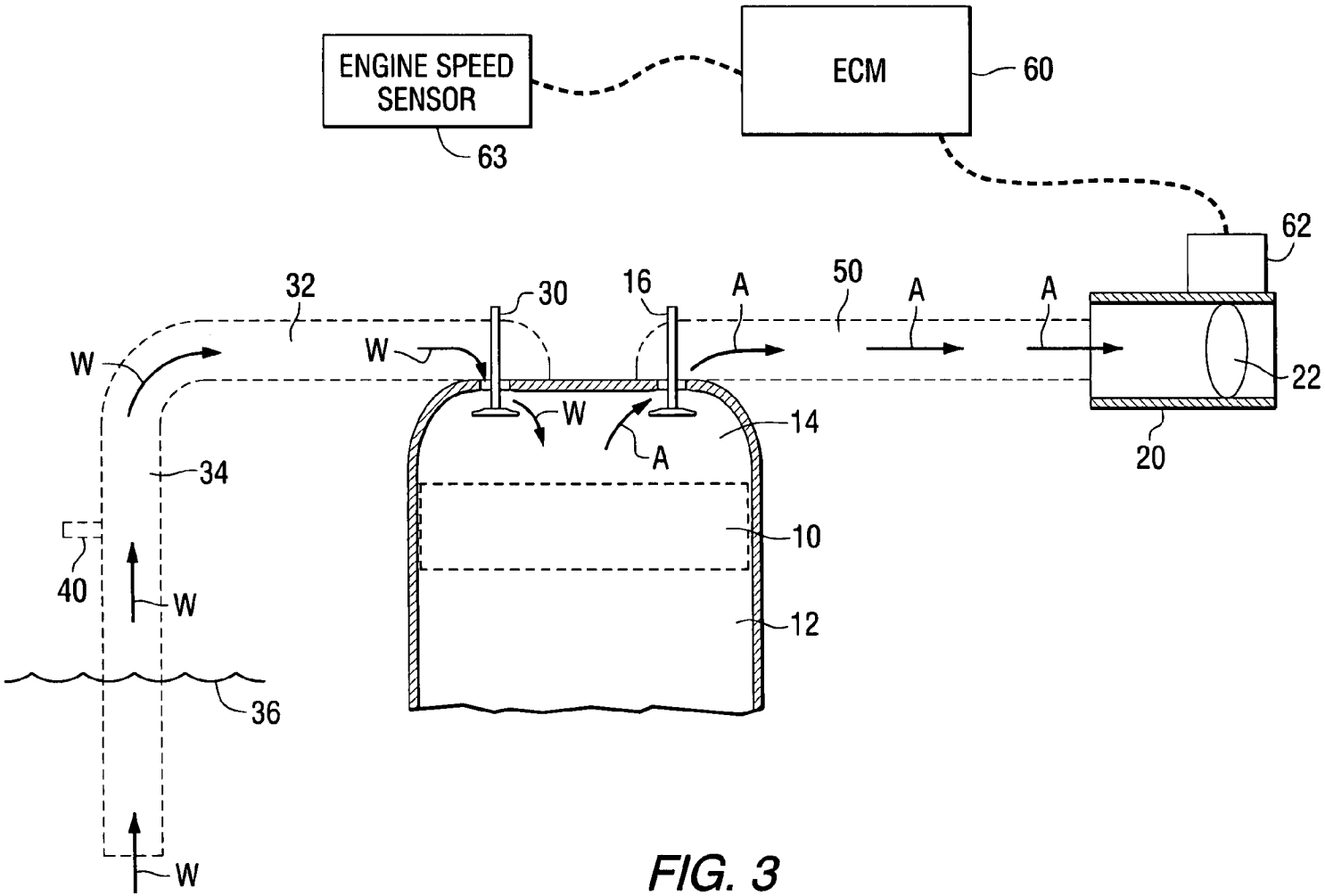
FIG. 3 shows a potentially harmful situation in which an engine is stopped with both intake and exhaust valves in an open position.

FIG. 3 shows a potentially deleterious situation that can occur during a shutdown of the engine. As described above, the intake valve 16 and the exhaust valve 30 can be simultaneously in an open position because of the valve overlap techniques used in certain gasoline engines. As a result, if these valves are both in an open position when the engine stops running, a situation can exist in which the pressure within the intake conduit 50 can be significantly less than the pressure within the exhaust conduit 32. If the throttle plate 22 is in a closed, or nearly closed, position, the pressure within the intake conduit 50 will be restricted from equalizing with ambient pressure. As a result, the lower pressure in the intake conduit 50 can draw fluid from the exhaust conduit 32 into the combustion chamber 14. If the volume of air within the intake conduit 50 is sufficiently great, this negative relative pressure can be sufficient to draw water upwardly through conduit 34, through the exhaust conduit 32, and into the combustion chamber 14. This flow of ingested water is represented by arrow W in FIG. 3 and the flow of air from the combustion chamber 14 into the intake conduit 50 is represented by arrows A.

With continued reference to FIG. 3, the method of the present invention prevents the water ingestion W from occurring by causing the air within the intake conduit 50 to more rapidly equalize with the ambient pressure upstream of the throttle body 20. This is done by causing the throttle plate 22 to move to a more open position during the shutdown procedure of the engine. An engine control module 60 senses the imminent cessation of operation of the engine and causes a throttle control mechanism 62 to move the throttle plate 22 to a more open position. This allows the air at atmospheric pressure, to the right of the throttle body 20 in FIG. 3, to flow in a leftward direction past the throttle plate 22 and into the intake conduit 50. This quickly reduces the degree of negative pressure of the intake conduit 50 in relation to the pressure within the exhaust conduit 32. As a result, the negative pressure is not available to draw the water W upwardly from the body of water. The ECM 60 is also provided with an engine speed sensor 63, such as a tachometer or gear tooth sensor, so that it can detect the engine speed.

Figure 4:
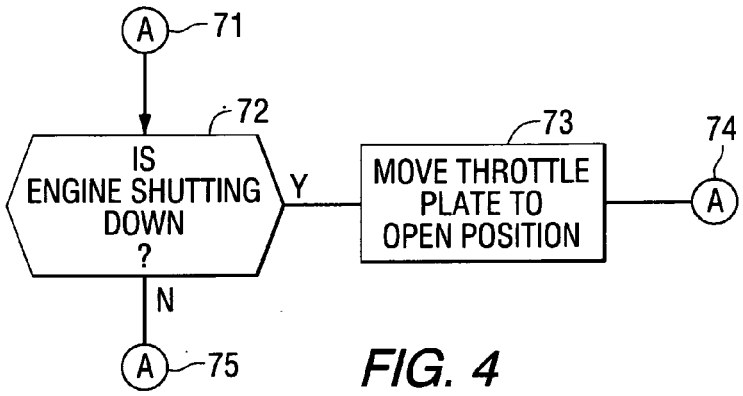
FIG. 4 is a simplified flowchart of one embodiment of the present invention.

The present invention can be implemented in several different embodiments. FIG. 4 shows one embodiment which is represented by a simplified flowchart. Beginning at process step A, which identified by reference numeral 71, the engine control module 60, described above in conjunction with FIG. 3, determines if the engine is shutting down at functional block 72. This step can be accomplished in several ways. One way is to simply monitor the rotational speed of the crankshaft of the engine. If that rotational speed, or operating speed of the engine, is less than a preselected threshold, the engine control module can deduce that the engine is going to stop soon. This threshold engine speed can be, for example, approximately 100 rpm. However, it should be understood that other magnitudes of threshold can be used for these purposes. In addition to comparing the engine speed to a preselected threshold, the engine control module can also monitor the deceleration, or change in operating speed, of the engine. In certain embodiments of the present invention, a two-step process is followed to determine that the cessation of operation is imminent. If the engine speed is decreasing (i.e. decelerating) and the engine speed has achieved a magnitude less than a preselected threshold, the engine control module concludes that the engine will soon stop.

If the engine is determined to be shutting down, as determined at functional block 72 in FIG. 4, the throttle plate is moved to a more open position at functional block 73. Then the algorithm returns to point A, as indicated by functional step 74. If, on the other hand, the engine is not shutting down as determined at functional block 72, the algorithm returns to the initial step A as indicated by functional step 75.

Figure 5:
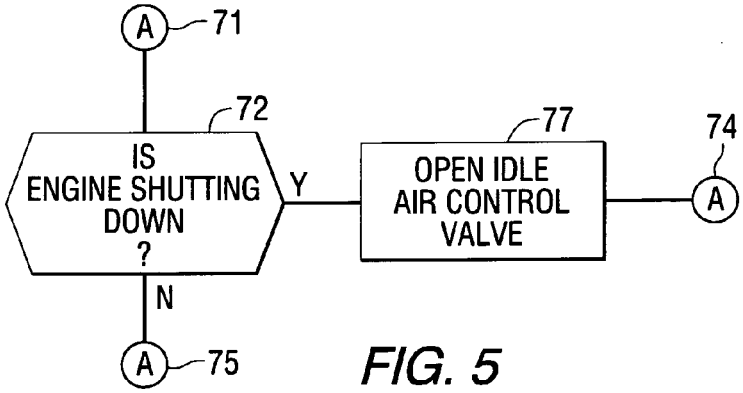
FIG. 5 is a simplified flowchart of another embodiment of the present invention.

FIG. 5 is very similar to FIG. 4 except that when it is determined that the engine is shutting down at functional step 72, the idle air control (IAC) valve is opened at functional block 77. The idle air control valve can be opened as an alternative step to the movement of the throttle plate to the open position as described above in functional step 73 of FIG. 4. In both of these alternative embodiments, the purpose of the functional steps 73 and 77 is to allow air to flow through the throttle body 20 in order to raise the pressure within the intake conduit 50 as described above in conjunction with FIG. 3, and equalize the pressure in the intake conduit 50 to the pressure in the exhaust conduit 32, which is approximately equal to ambient pressure.

Figure 6:
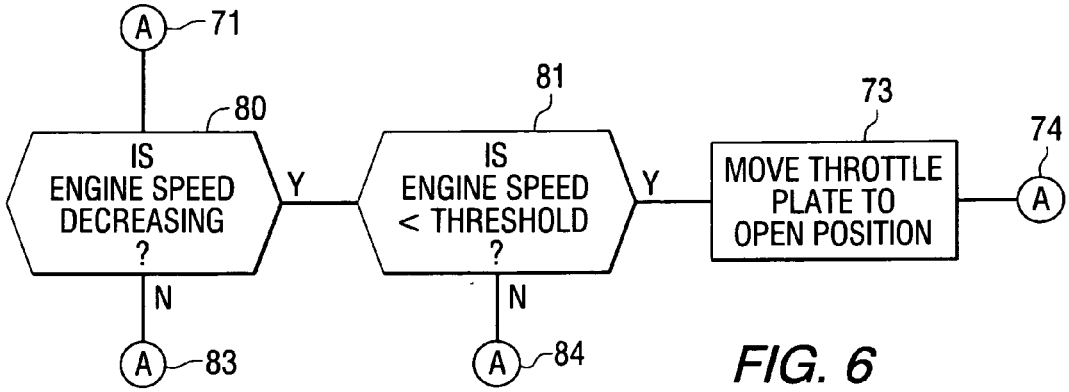
FIG. 6 is a simplified flowchart of an additional embodiment of the present invention.

FIG. 6 illustrates the embodiment of the present invention in which the decision described above in conjunction with process step 72 in FIGS. 4 and 5 is performed in a two-step procedure. Those two steps are identified by functional steps 80 and 81 in FIG. 6. At functional step 80, the engine control module determines whether or not the engine speed is decreasing. If the engine is determined to be decelerating, the engine control module then interrogates the actual engine speed at functional block 81 to determine whether it is less than a threshold magnitude. If the results in the interrogations of both functional blocks 80 and 81 are both affirmative, the engine control module decides that the engine is about to stop and the throttle plate is moved to a more open position as identified in functional block 73 or, alternatively, the idle air control valve could be moved to an open position as described above in conjunction with functional block 77 of FIG. 5. If either the engine speed is not decreasing or the engine speed has not yet reached a magnitude less then the threshold, the algorithm returns to the initial step 71, as indicated by functional steps 83 and 84 in FIG. 6. In a particularly preferred embodiment of the present invention, the negative pressure (i.e. less than atmospheric pressure) within the intake manifold 50 is increased by opening the throttle plate 22 or opening an idle air control valve. The pressure in the air intake conduit 50 is thereby increased in an attempt to equalize the pressures in the intake and exhaust conduits, 50 and 32. This equalization of pressure will inhibit the drawing of water W upwardly through the exhaust system. In certain embodiments of the present invention, a signal from the operator of the marine vessel can be used to indicate the imminent cessation of the engine, such as when the operator turns an ignition key to an off position. However, this technique may not include all possible causes of engine cessation. The engine may stall during a startup procedure, may stall for any other reason during normal operation, or may be shutdown intentionally by the operator. The algorithm used to determine the imminent cessation of the engine therefore should consider all significantly relevant possibilities. Typically, the achievement of an operating speed less than a threshold magnitude while the engine speed is decreasing is an adequate test to determine the imminent cessation of the engine operation.

Although the present invention has been described in considerable detail and illustrated to show specific embodiments, it should be understood that alternative embodiments are also within its scope.

I claim:

1. A method for operating a marine engine, comprising the steps of:

detecting an imminent cessation of operation of an engine; and increasing the pressure within an intake conduit of said engine relative to the pressure within an exhaust conduit of said engine upon detection of said imminent cessation of operation of an engine, said pressure increasing step comprising the step of causing an air intake throttle plate to move to an increasingly opened position.

2. The method of claim 1, wherein:

said detecting step comprises the steps of determining an operating speed of said engine and determining that said operating speed is less than a preselected threshold magnitude.

3. The method of claim 1, wherein:

said detecting step comprises the steps of determining an operating speed of said engine and determining that said operating speed is both decreasing and less than a preselected threshold magnitude.

4. The method of claim 1, wherein:

said detecting step comprises the step of receiving an engine shutdown signal from an engine control unit.

5. The method of claim 1, wherein:

said detecting step comprises the step of receiving an engine shutdown signal from an operator of a marine vessel.

6. The method of claim 1, wherein:

said pressure increasing step comprises the step of causing an idle air control valve to move to an increasingly opened position.

7. The method of claim 1, wherein:

said engine is a four cycle engine.

8. The method of claim 1, wherein:

said pressure increasing step comprises the step of causing said pressure within said intake conduit of said engine to become closer in magnitude to the pressure upstream of a throttle plate of said engine.

9. The method of claim 1, wherein:

said pressure increasing step comprises the step of increasing said pressure within said intake conduit of said engine.

10. A method for operating a marine engine, comprising the steps of:

detecting a future cessation of operation of a four cycle engine; and increasing the pressure within an intake conduit of said engine relative to the pressure within an exhaust conduit of said engine upon detection of said imminent cessation of operation of an engine, said pressure increasing step comprising the step of causing an idle air control valve to move to an increasingly opened position.

11. The method of claim 10, wherein:

said detecting step comprises the steps of determining an operating speed of said engine and determining that said operating speed is less than a preselected threshold magnitude.

12. The method of claim 10, wherein:

said detecting step comprises the steps of determining an operating speed of said engine and determining that said operating speed is both decreasing and less than a preselected threshold magnitude.

13. The method of claim 10, wherein:

said pressure increasing step comprises the step of causing an air intake throttle plate to move to an increasingly opened position.

14. The method of claim 10, wherein:

said pressure increasing step comprises the step of causing said pressure within said intake conduit of said engine to become closer in magnitude to the pressure upstream of a throttle plate of said engine.

15. The method of claim 10, wherein:

said pressure increasing step comprises the step of increasing said pressure within said intake conduit of said engine.

16. A method for operating a marine engine, comprising the steps of:

detecting a future cessation of operation of a four cycle engine; and increasing the pressure within an intake conduit of said engine, said pressure increasing step comprising the steps of causing said pressure within said intake conduit of said engine to become closer in magnitude to the pressure upstream of a throttle plate of said engine.

17. The method of claim 16, wherein:

said pressure increasing step comprises the step of causing an idle air control valve to move to an increasingly opened position.

* * * * *